United States Patent [19]

Jan

[11] Patent Number: 4,750,651

[45] Date of Patent: Jun. 14, 1988

[54] DETACHABLE AND FOLDABLE SUIT HANGER

[76] Inventor: Cow-Mar Jan, No. 39-3, Alley 350, Li Zen Rd., Tainan City, Taiwan

[21] Appl. No.: 55,424

[22] Filed: May 28, 1987

[51] Int. Cl.[4] ..... A47G 25/42; A47G 25/16

[52] U.S. Cl. ..... 223/89; 223/94; 211/119

[58] Field of Search ..... 223/89, 90, 88, 94, 223/92, 85, DIG. 4; 211/118, 119

[56] References Cited

U.S. PATENT DOCUMENTS 787,622 4/1905 Hawley ..... 223/91

*Primary Examiner*—Robert R. Mackey

*Attorney, Agent, or Firm*—Morton J. Rosenberg

[57] ABSTRACT

A detachable and foldable suit hanger comprises an upper frame having a head portion, a body portion, a leg portion and a pair of turnbacks at the ends of the leg portion, and a lower frame having a neck, a shoulder, a cross bar and a pair of loops at the middle portion of the cross bar. The head portion, the body portion and leg portion are shaped by doubling a resilient cord in a gradually enlarged way. The upper frame is mounted on a support with the body portion and the lower frame is hung on the turnbacks by the neck. The upper frame not in use may be folded by allowing the upper frame to be clamped by the loops.

1 Claim, 3 Drawing Sheets

DETACHABLE AND FOLDABLE SUIT HANGER

BACKGROUND OF THE PREFERRED EMBODIMENT OF THIS INVENTION

This invention relates to a suit hanger, more particularly to a detachable and foldable suit hanger.

The conventional suit hanger is hung on a support or a rope by means of a swivel hook or an ordinary hook. Since the conventional suit hanger applies its weight or the weight of the suit in addition to ensure the hanging function, it is easily blown off the rope or the support by a high wind.

To obviate the defect of the conventional suit hanger, one object of this invention is to provide a detachable and foldable suit hanger which is more securedly hung on the support.

Another object of this invention is to provide a detachable and foldable suit hanger which is detachable and foldable when it is not in use.

Other objects, merits and a fuller understanding of this invention will be obtained by those having ordinary skill in the art when the following detailed description of the best mode contemplated for practicing the invention is read in conjunction with accompanying drawings wherein like numerals refer to like or similar parts and in which:

DETAILED DESCRIPTION OF THE PREFERRED EMBODIMENT OF THIS INVENTION

This invention relates to a suit hanger, more particularly to a detachable and foldable suit hanger.

Figure 1:
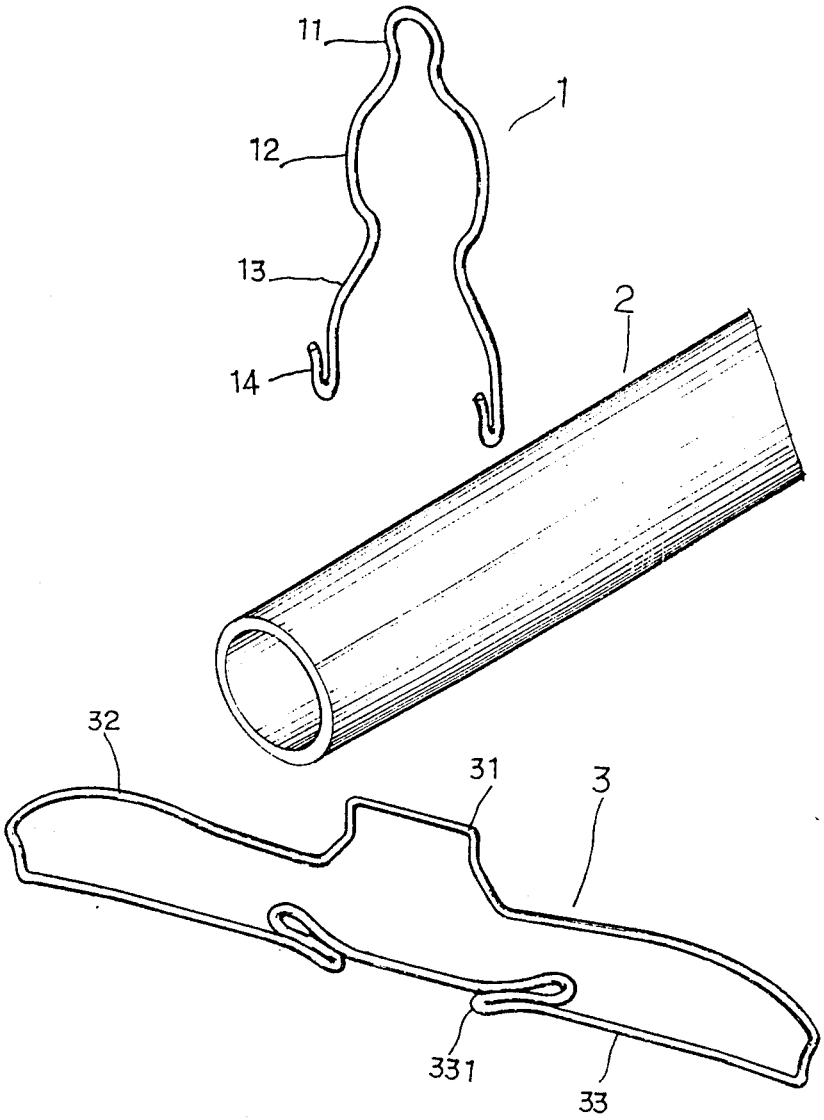
FIG. 1 is a perspective view of a preferred embodiment of this invention in a detached position.

As shown in FIG. 1, a preferred embodiment of this invention comprises an upper frame 1 having a head portion 11, a body portion 12 and a leg portion 13. The head portion 11, the body portion 12 and leg portion 13 are integrally made of a resilient cord and the right half and left half are symmetrical to each other in shape. Particularly, either half of the head portion 11, the body portion 12 and leg portion 13 is in a waved shape and greater in sequence in wave length and wave height. The upper frame 1 is opened at the lower ends of the leg portion 13. At either lower end of the leg portion 13 a turnback 14 is provided. The turnbacks 14 are at one side of the common plane shared by the head portion 11, body portion 12 and leg portion 13. The head portion 11 is provided for hanging on any hook, the body portion 12 for clamping a bamboo 2, the leg portion 13 for the bamboo 2 to insert therethrough and the turnbacks 14 for a lower frame 3 to hang thereon.

Figure 2:
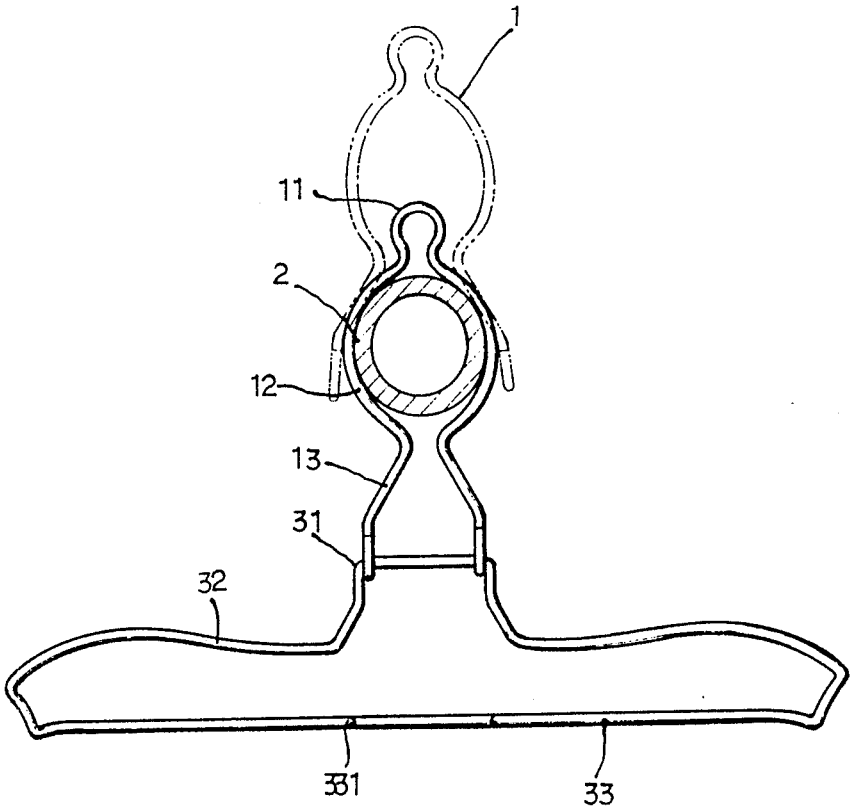
FIG. 2 is a perspective view of the preferred embodiment of this invention as shown in FIG. 1 in a hanging position with dotted lines to show how an upper frame of this invention is mounted on a bamboo which is in cross section.
Figure 4:
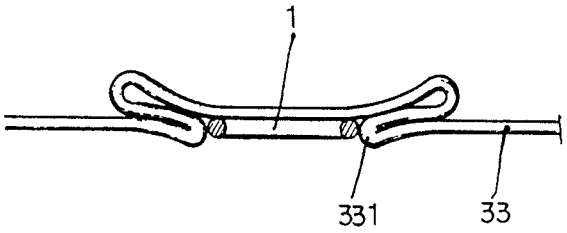
Figure 3:
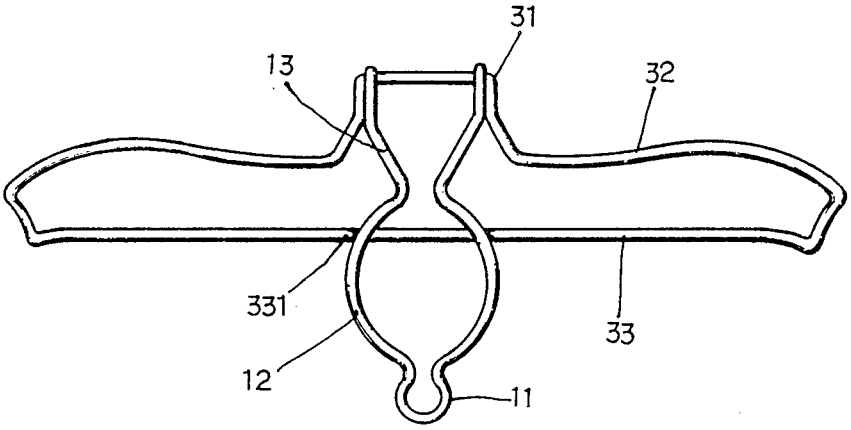
FIG. 3 is a perspective view of the preferred embodiment of this invention as shown in FIG. 1 in a folded position; and, FIG. 4 is a view of FIG. 3 partially broken away and partially in cross section.

The lower frame 3 has a neck 31, a shoulder 32 and a cross bar 33 all of which are integrally made of a resilient cord. A pair of loops 331 are formed at the middle portion of the cross bar 33. Preferablly, the length of the neck 31 is shorter than the distance between the two turnbacks 14. The loops 331 are provided at one side of the common plane shared by the neck 31, the shoulder 32 and cross bar 33. The neck 31 is provided for hanging on the turnbacks 14, the shoulder 32 for hanging thereon the suit and the loops 331 for the upper frame 1 to be clamped thereon when folded as shown in FIGS. 3 and 4. As FIG. 2 shows, in use, the upper frame 1 is mounted on the bamboo 2 by the leg portion 13 and further pressed downward for the body portion 12 to sleeve and clamp on the bamboo 2 and still further the lower frame 3 is hung with the neck 31 on the turnbacks 14 of the upper frame 1. As FIGS. 3 and 4 shows, not in use, the upper frame 1 is turned about the neck 31 for 90° and then clamped by the loops 331 of the lower frame 3.

It is to be noted that the above description aims to explain however not to limit the concept of this invention.

What is claimed is:

1. A detachable and foldable suit hanger comprising:

an upper frame having a head portion, a body portion and a leg portion all of which are integrally made of a resilient cord, the right and left half of said head portion, body portion and leg portion being symmetrical to each other and either half being in waved shape which is greater in sequence in wave length and height, said upper frame being opened at the lower ends of said leg portion, said upper frame including a pair of turnbacks formed at the lower ends of said leg portion and integral therewith, said turnbacks being provided at one side of the common plane shared by said head portion, said body portion and said leg portion; and, a lower frame having a neck, a shoulder and a cross bar all of which are integrally made of a resilient cord, said lower frame including a pair of loops provided at the middle portion of said cross bar, said loops being at one side of the common plane shared by said neck, said shoulder and said cross bar, said turnbacks being releasably and rotatably coupled to said lower frame neck, said upper frame body portion being insertable within said pair of loops for clamping engagement of said upper frame to said lower frame when said upper frame is rotated about said lower frame neck.

* * * * *